US005865719A

United States Patent [19]

Droste et al.

[11] Patent Number: 5,865,719

[45] Date of Patent: Feb. 2, 1999

[54] SELF-EMPTYING CENTRIFUGAL DRUM

[75] Inventors: Johannes Droste; Norbert Wegener, both of Oelde, Germany

[73] Assignee: Westfalia Separator AG, Oelde, Germany

[21] Appl. No.: 809,272

[22] PCT Filed: May 18, 1995

[86] PCT No.: PCT/EP95/01883

§ 371 Date: Mar. 7, 1997

§ 102(e) Date: Mar. 7, 1997

[87] PCT Pub. No.: WO96/08313

PCT Pub. Date: Mar. 21, 1996

[30] Foreign Application Priority Data

Sep. 15, 1994 [DE] Germany ..... 44 32 836.2

[51] Int. Cl.[6] ..... B04B 11/02

[52] U.S. Cl. ..... 494/27; 494/40; 210/360.1; 210/380.1

[58] Field of Search ..... 210/104, 360.1, 210/374, 380.1; 494/27, 40

[56] References Cited

U.S. PATENT DOCUMENTS

| | | | |
|---|---|---|---|
| 3,747,840 | 7/1973 | Weiland | 494/40 |
| 3,938,734 | 2/1976 | Wilke | 494/40 |
| 4,401,429 | 8/1983 | Koslowski | 494/40 |
| 4,479,788 | 10/1984 | Kohlstette | 494/40 |
| 4,717,376 | 1/1988 | Bruning et al. | 494/40 |
| 4,781,670 | 11/1988 | Kohlstette | 494/27 |
| 4,810,374 | 3/1989 | Bruning et al. | 210/104 |

FOREIGN PATENT DOCUMENTS

| | | |
|---|---|---|
| 1532676 | 10/1966 | Germany . |
| 3826912 | 8/1988 | Germany . |

*Primary Examiner*—David A. Reifsnyder
*Attorney, Agent, or Firm*—Sprung Kramer Schaefer & Briscoe

[57] ABSTRACT

A self-emptying centrifuge drum has a collecting channel for emptying the drum and a fitting for introducing water into the collecting channel. The drum is rotatable and is hydraulically actuatable by water introduced into the collecting channel through the fitting. The collecting channel rotates with the drum about an axis of rotation and the fitting is stationary and has at least one outlet. A baffle extends up from below the collecting channel and between the collecting channel and the fitting and has a lower portion below the collecting channel and an upper portion extending into an area radially inward of the collecting channel with respect to the axis of rotation. The at least one outlet of the fitting is aimed at the lower portion of the baffle.

7 Claims, 1 Drawing Sheet

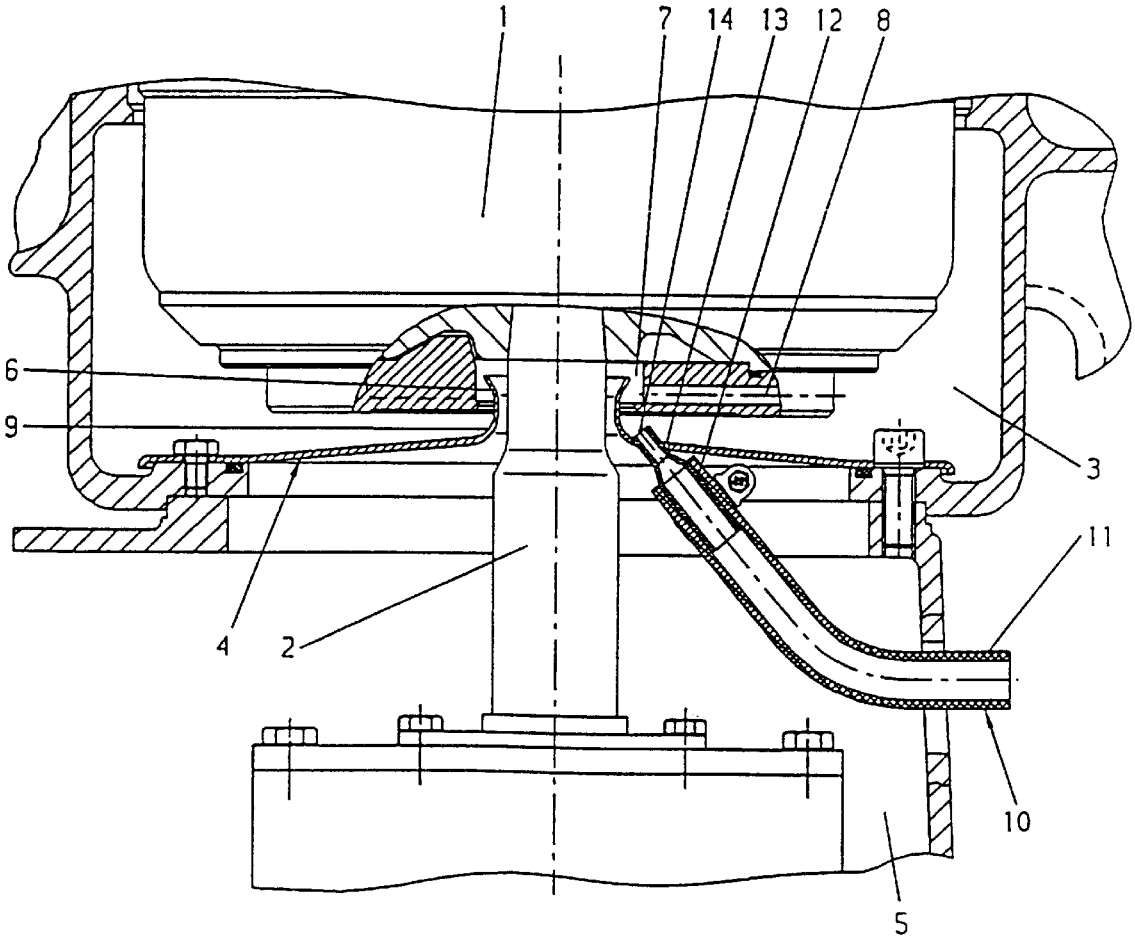
1
7
14
13
12
8
6
9
3
11
4
2
10
5

SELF-EMPTYING CENTRIFUGAL DRUM

BACKGROUND OF THE INVENTION

The present invention concerns a self-emptying centrifuge drum with at least one valve for releasing solids. The drum is actuated hydraulically by water introduced into a collecting channel through a fitting. The collecting channel rotates with the drum, and the fitting is stationary and has at least one outlet.

A drum of this type is known, from German 3 826 912 C1 for example. The water fitting extends in the form of an enclosed channel into the area radially inside the collecting channel. The spindle that rotates the drum extends through the same area. The inside diameter of the collecting channel is accordingly dictated by the diameter of the spindle and by the radial length of the water fitting in the vicinity of the collecting channel. The stationary fitting must also be far enough from the rotating collecting channel and from the rotating spindle. Since an enclosed channel takes up a lot of space radially with its wall and free cross-section, the inside diameter of the collecting channel must accordingly be longer. The greater the capacity of the collecting channel, however, the weaker the hydraulic pressure generated by the water flowing into the collecting channel. Attempts are accordingly made to keep the diameter of the collecting channel as short as possible.

Making the water fitting a double-walled ring surrounding the spindle in the vicinity of the collecting channel has also been proposed, in German OS 1 532 676 for instance. This makes it possible to decrease the radial length of the water fitting without altering the open cross-section that the water flows through. The same design allows several water outlets in the vicinity of the collecting channel, facilitating the introduction of water into the collecting channel. Water fittings of this type are complicated, however, and always require the collecting channel to be relatively wide. All double-walled water fittings, furthermore, entail the risk of constricting the flow with deposits of dirt or lime.

SUMMARY OF THE INVENTION

The object of the present invention is a simple and cost-effective water fitting with a collecting channel that has an inside diameter smaller than that of the known fittings.

This object is attained in accordance with the present invention by means of a baffle extending up from below the collecting channel and between it and the water fitting into an area radially inside the collecting channel, whereby the water outlet is aimed at the lower portion of the baffle.

The water flows up to the upper portion of the baffle, and water rushing out thereby is channeled into the collecting channel. The only radial length on the part of the water fitting that needs to be taken into account is the thickness of the baffle. The double wall employed in known water fittings is eliminated along with the space needed inside the wall to create an annular channel, or the inside of the enclosed channel, Much less space will accordingly be occupied radially than in known designs, and manufacturing costs can be greatly decreased. There is also much less risk of contaminating the water fitting.

The water outlet in one advantageous embodiment of the present invention slopes steeply up toward the surface of the baffle. The water on the baffle will accordingly flow upward.

The baffle in another advantageous embodiment is rotationally symmetric and concentric to the axis of rotation of the centrifuge drum. The rotating collecting channel generates turbulence in the air that distributes the water over the total circumference of the baffle. This feature optimizes the flow of water into the collecting channel.

The baffle in another advantageous embodiment has an upper portion that flairs radially out toward the collecting channel. The flow of water into the collecting channel from the baffle will accordingly be especially satisfactory.

The baffle in another advantageous embodiment constitutes a floor that separates the transmission housing from the drum housing above it. No partition is needed in this embodiment to keep water out of the transmission housing.

The water fitting in another advantageous embodiment is composed of a hose and a nozzle. The nozzle accommodates the outlet. Such a structure is very cost-effective and easy to install.

The water fitting in another advantageous embodiment, finally, can extend through the transmission housing and its outlet through a bore in the baffle. The water fitting in this embodiment does not need to be specially attached to the baffle. The upper surface of the baffle is not cluttered with lengths of tubing that could provoke disruptive turbulence in the air.

BRIEF DESCRIPTION OF THE DRAWING

The FIGURE is a cross-sectional view of a drum according to the invention.

DETAILED DESCRIPTION OF THE INVENTION

A centrifuge drum 1 is driven by a spindle 2 and rotates in a housing 3. Housing 3 is separated from a transmission housing 5 by a baffle 4. An upper portion 6 at the center of baffle 4 flairs out toward a collecting channel 7 on the bottom of drum 1. Collecting channel 7 communicates through a channel 8 with an unillustrated valve for the purpose of emptying the drum. The lower portion 9 of baffle 4 is below collecting channel 7. Attached to lower portion 9 is a water fitting 10. Fitting 10 extends through transmission housing 5. The fitting is composed of a hose 11 and a nozzle 12. The outlet 14 of nozzle 12 extends through a bore 13 in lower portion 9 and slopes up steeply toward lower portion 9.

How the drum empties will now be specified. Water is introduced through fitting 10 and forced steeply and rapidly up out of the outlet 14 in nozzle 12 toward the lower portion 9 of baffle 4. The water on the upper surface of baffle 4 will accordingly flow toward upper portion 6. The flair on upper portion 6 will effectively divert the water on that surface into collecting channel 7, reinforcing the hydraulics. The turbulent air in the vicinity of rotating collecting channel 7 will distribute the water introduced locally to lower portion 9 with considerable uniformity over the circumference of upper portion 6. The water will accordingly flow optimally from baffle 4 to collecting channel 7.

What is claimed is:

1. A self-emptying centrifuge drum having a collecting channel for emptying the drum; a fitting for introducing water into the collecting channel; wherein the drum is rotatable and is hydraulically actuatable by water introduced into the collecting channel through the fitting; wherein the collecting channel rotates with the drum about an axis of rotation and the fitting is stationary and has at least one outlet; and a baffle extending up from below the collecting channel and between the collecting channel and the fitting and having a lower portion below the collecting channel and an upper portion extending into an area radially inward of the collecting channel with respect to the axis of rotation and wherein the at least one outlet of the fitting is aimed at the lower portion of the baffle.

2. The self-emptying drum according to claim 1, wherein the fitting has a first section and a second section leading to the at least one outlet and extending upwardly at an acute angle with respect to the first section.

3. The self-emptying drum according to claim 1, wherein the baffle is rotationally symmetric and concentric to the axis of rotation.

4. The self-emptying drum according to claim 1, wherein the upper portion of the baffle flairs radially outwardly with respect to the axis of rotation towards the collecting channel.

5. The self-emptying drum according to claim 1, further comprising a drum housing surrounding the drum and a transmission housing below the drum housing and wherein the baffle separates the transmission housing from the drum housing.

6. The self-emptying drum according to claim 1, wherein the fitting comprises a hose and a nozzle having the at least one outlet.

7. The self-emptying drum according to claim 1, further comprising a transmission housing below the drum and wherein the fitting extends through the transmission housing and wherein the at least one outlet extends through a bore in the baffle.

* * * * *